United States Patent [19]

Shay et al.

[11] 4,334,938

[45] Jun. 15, 1982

[54] INHIBITED ANNEALING OF FERROUS METALS CONTAINING CHROMIUM

[75] Inventors: Robert H. Shay, Kutztown; Thomas L. Ellison, Slatington, both of Pa.

[73] Assignee: Air Products and Chemicals, Inc., Allentown, Pa.

[21] Appl. No.: 180,241

[22] Filed: Aug. 22, 1980

[51] Int. Cl.[3] ..... C21D 1/48

[52] U.S. Cl. ..... 148/16.7; 148/16.6

[58] Field of Search ..... 148/12.1, 16, 16.5, 148/16.6, 16.7, 20.3

[56] References Cited

U.S. PATENT DOCUMENTS

| | | | |
|---|---|---|---|
| 1,789,187 | 1/1931 | McFarland | 148/16.7 |
| 3,262,821 | 7/1966 | Yoshida | 148/12.1 |
| 3,873,377 | 3/1975 | Fisher | 148/16.7 |
| 3,966,509 | 6/1976 | Podgurski | 148/16 |
| 4,012,239 | 3/1977 | Brun et al. | 148/6.3 |
| 4,145,232 | 3/1980 | Solomon | 148/20.3 |
| 4,175,986 | 11/1979 | Ewalt et al. | 148/16.5 |
| 4,200,477 | 4/1980 | Datta et al. | 148/113 |
| 4,208,224 | 6/1980 | Girrell | 148/16.5 |

OTHER PUBLICATIONS

Koebel, N. K., "Furnace Atmospheres", *Iron and Steel Engineer*, pp. 81–93, Jul. 1964.

Koebel, N. K., "Surface Activation in the Heat Treatment of Metals", pp. 14–19, *Heat Treating*.

*Primary Examiner*—L. Dewayne Rutledge

*Assistant Examiner*—John P. Sheehan

*Attorney, Agent, or Firm*—James C. Simmons; E. Eugene Innis

[57] ABSTRACT

A process for limiting the absorption of nitrogen by ferrous metal containing chromium as an alloying additive (e.g. stainless steel) during high temperature annealing in an atmosphere of nitrogen and hydrogen by controlled additions of an inhibitor selected from the group consisting of water vapor, oxygen, nitrous oxide, carbon dioxide or mixtures thereof to the atmosphere while controlling the dew point of the furnace atmosphere and/or the ratio of the partial pressure of the inhibitor to the partial pressure of the hydrogen.

5 Claims, 5 Drawing Figures

RETAINED N (WEIGHT %)
1.2
1.0
0.8
0.6
0.4
0.2
0
0 10 20 30 40 50 60 70 80 90 100
N2 (GAS VOLUME %)

○ = 80% N2 - 20% H2
△ = 80% N2 - 10% H2 - 10% Ar
□ = 80% N2 - 5% H2 - 15% Ar
● = 90% N2 - 10% H2
RETAINED N (WEIGHT %)
1.2
1.0
0.8
0.6
0.4
0.2
0
0 10 20 30 40 50 60 70 80 90 100 110 120
PH2O / PH2 x 10^5

○ = 985° C
● = 1040° C
△ = 1095° C
RETAINED N (WEIGHT %)
1.2
1.0
0.8
0.6
0.4
0.2
0
0 10 20 30 40 50 60 70 80 90 100 110 120
PN2O / PH2 x 10^5

INHIBITED ANNEALING OF FERROUS METALS CONTAINING CHROMIUM

TECHNICAL FIELD

This invention pertains to the annealing of ferrous metals containing chromium under conditions wherein the furnace atmosphere is controlled to prevent reaction of the metal with components of the furnace atmosphere.

BACKGROUND OF PRIOR ART

Ferrous metal and in particular, stainless steels when subjected to working processes such as drawing, stamping and bending, become hardened and contain microstructural stresses which render further working difficult or impossible.

Stainless steels are those which contain at least 11% chromium. The chromium markedly increases the corrosion resistance of the steel because of the formation of a very thin invisible passivating surface layer of chromium oxide which effectively protects the underlying metal from further reaction. Austenitic stainless steels are those which contain substantial quantities of nickel in addition to the chromium. For example, a common austenitic stainless steel is American Iron and Steel Institute (AISI) Type 302 which contains nominally 18% chromium and 8% nickel as its major alloying elements. In addition, the Austenitic Stainless Steels show transformation of the microstructure to martensite under heavy working stresses. Annealing is a process whereby the metal is heated to a high temperature which results in relief of trapped stresses and work hardening and formation of a solid solution of carbon in the austenite. Austenitic stainless steels are usually annealed at temperatures of 1700° to 2100° F. (927° to 1149° C.) to minimize formation of chromium carbides which sensitize the steel to corrosion.

Annealing must be carried out in an atmosphere which causes minimal chemical alteration of the metal by diffusion of atmosphere components into the surface of the metal. Excessive oxidation produces green, brown or black discoloration. In bright annealing (e.g. under an atmosphere of hydrogen and nitrogen) oxidation must be held to a level where no visible alteration of the surface occurs. Carburizing atmospheres may cause the precipitation of carbides of chromium and other metals which sensitize the steel to corrosion. Pure hydrogen is usually technically satisfactory as an annealing atmosphere, but it is more expensive than some other gaseous combinations.

Mixtures of hydrogen and nitrogen have been employed as annealing atmospheres for stainless steel. A commonly used combination, consisting of 75% hydrogen and 25% nitrogen, results from the cracking of ammonia. The generation of this atmosphere requires equipment for vaporization of liquid ammonia, and for cracking it over a suitable catalyst at a high temperature. Labor and energy are required for the operation and maintenance of the atmosphere generator. Furthermore, great care must be taken to ensure that cracking is complete with no residual ammonia which may cause nitriding of stainless steel. Nitriding is undesirable since it may promote intergranular corrosion, and cause severe embrittlement of the stainless steel. Most industrially generated dissociated ammonia atmospheres contain between 50 ppm and 500 ppm of undissociated ammonia. Because of this, an industrial atmosphere produced by dissociating ammonia cannot be directly equated to a 75% $H_2$-25% $N_2$ atmosphere in regard to nitrogen absorption in finished (treated) parts.

More recently, inexpensive by-product nitrogen has been used as a base for stainless steel annealing atmospheres. A typical atmosphere consists of nitrogen containing from 10 to 50% hydrogen. However, such atmospheres may give rise to even more severe intergranular corrosion than is experienced with cracked ammonia. The hydrogen component of the atmosphere is capable of reducing the thin protective film of chromium oxide and exposing bare metal which then reacts readily at the high temperature of annealing with molecular nitrogen in the atmosphere. Since these synthetic atmospheres contain a higher concentration of nitrogen than does cracked ammonia, the degree of nitriding may be even more pronounced.

It has been known for some time that addition of small amounts of water, that is slight humidification of the atmosphere, limits the uptake of nitrogen by stainless steel to an acceptable level. Water addition may range, by weight, from less than 0.1% to 0.5%, depending on the type of steel and the application. It has also been known that addition of trace quantities of oxygen to the atmosphere also prevents excessive nitriding by synthetic nitrogen/hydrogen mixtures prepared by the dissociation of ammonia. The mechanism for the effectiveness of water and oxygen in preventing nitriding of stainless steel during annealing operations has been identified as resulting from the formation or preservation of a thin chromium oxide layer through oxidation of the metal surface by oxygen or water. A description of the state of the art is set forth in the articles by N. K. Koebel appearing in the July 1964 edition of *Iron and Steel Engineer* pp. 81 through 93 and the December 1977 edition of *Heat Treating* pp. 14 through 19.

However, as practical means for the limitation of nitriding by annealing atmospheres, both oxygen and water have been difficult to use. Both are highly reactive toward stainless steel at elevated temperatures, and unless the quantity of inhibitor is controlled with extreme care, excessive attack of the metal with the resultant formation of unsightly dark metal oxide coatings will take place.

Further, water, being a liquid presents handling problems not encountered with gases. Since only a very small quantity of water is required, provision must be made for the accurate continuous measurement of a tiny volume. This may require elaborate mechanical equipment, subject to continual maintenance and attention. If one elects to add the water by humidification of a sidestream of furnace atmosphere provision must be made for an appropriate humidifying device held at a closely controlled temperature. Successful operation of the stainless steel annealing process therefore is dependent upon the proper functioning of a number of complicated and delicate pieces of control equipment.

BRIEF SUMMARY OF THE INVENTION

This invention provides a means for limiting nitriding of stainless steel during annealing operations which is simple, reliable, and inexpensive.

It has been found that nitrous oxide and carbon dioxide are ideally suited for the limitation of nitriding of stainless steel in synthetic atmospheres comprised of nitrogen and hydrogen. Unlike water, both of these substances are gases which may be conveniently stored in cylinders under pressure. The equipment for adding them to a synthetic atmosphere being supplied to an annealing furnace is extremely simple, consisting essentially of a control device and a measuring device. For example, a simple pressure regulator, needle valve, and rotameter will suffice to deliver a precisely determined quantity of either nitrous oxide or carbon dioxide to a furnace. More elaborate control machinery to maintain a constant ratio of additive to base gas as the later is varied, or to vary the ratio according to a predetermined plan, is easily devised using well-known and widely employed components.

Being compounds of oxygen, nitrous oxide and carbon dioxide are less active than the element oxygen itself, and therefore are less inclined to aggressively attack the surface of the stainless steel and cause excessive and undesirable surface oxidation. Despite this lower activity, both gases are capable of providing excellent protection against nitriding of the stainless steel during the annealing operation.

DETAILED DESCRIPTION OF INVENTION

Figure 1:
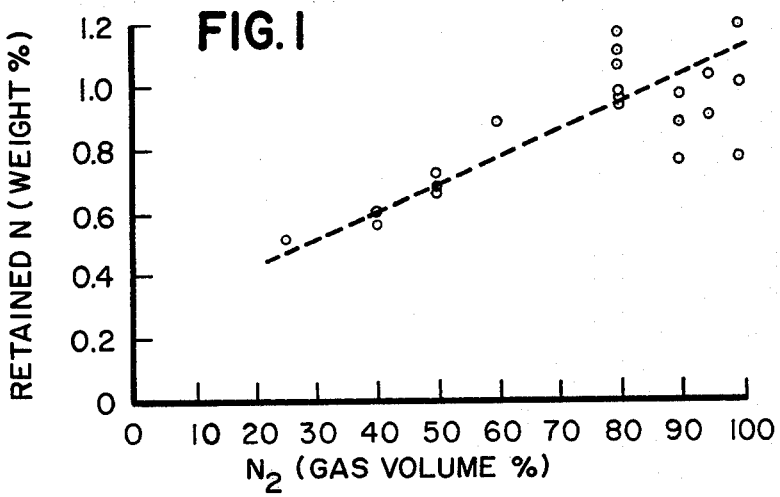
FIG. 1 is a plot of percent by weight of retained nitrogen against percent by volume of gaseous nitrogen for stainless steel samples annealed at 1040° C. (1904° F.) in various hydrogen-nitrogen gas mixtures.

Nitrogen absorption during the annealing of chromium alloy steels and in particular chromium nickel stainless steels in hydrogen-nitrogen (H-N) atmospheres is achieved by controlling the ratio of the partial pressure of a selected inhibitor (e.g. water vapor, oxygen, nitrous oxide, carbon dioxide or mixtures thereof) to the partial pressure of hydrogen in the furnace atmosphere. The ratio is controlled so the atmosphere is neither oxidizing nor allows significant nitrogen absorption to occur. A preferred minimum value of 20 for this ratio results in inhibiting nitrogen absorption and visible oxidation is not present.

Prior published articles show the use of trace water (and oxygen) additions to inhibit nitrogen absorption during the annealing of stainless steels in dissociated ammonia atmospheres. Dissociated ammonia atmospheres are made by cracking ammonia in the presence of a heated catalyst according to the reaction:

$$2NH_3 \xrightarrow[\text{catalyst}]{1900^\circ\text{ F.}} N_2 + 3H_2$$

Because of the nature of the chemical reaction, the atmosphere produced by this process is, without variation, composed of 25% nitrogen, 75% hydrogen. Dissociated ammonia atmospheres typically have a dew point (moisture content) of between −60° F. and −30° F. Trace quantities of ammonia are also usually present in the annealing atmosphere. Prior workers have shown that from 0.1% to 0.3% nitrogen can be absorbed by annealing in dissociated ammonia. Despite the fact that dissociated ammonia results in some nitrogen absorption, in practice, it is used for heat treating most of the unstabilized grades of stainless steel. Stabilized grades of stainless steel contain special alloy elements such as Ti and Nb which are added to combine with carbon and prevent corrosion sensitization by the reaction:

$$23Cr + 6C \rightarrow C_6Cr_{23}$$

Since nitrogen also reacts with Ti and Nb, their effectiveness is reduced when nitrogen absorption occurs.

In most cases, the nitrogen absorption is small enough that no noticeable intergranular corrosion occurs. In cases where this is a problem, pure hydrogen is generally used. The work done by Koebel noted above focussed on solving the problems associated with the use of dissociated ammonia to process stabilized grades of stainless steels and steels for other critical applications which require low levels of nitrogen absorption.

Nitrogen absorption becomes a much greater problem when stainless steels are annealed in low hydrogen-high nitrogen percentage industrial gas mixtures. Stainless steels such as American Iron and Steel Institute (AISI) Type 304 which can be successfully processed in dissociated ammonia, show severe intergranular corrosion when annealed in a low dew point 20% hydrogen, 80% nitrogen industrial gas mixture. Nitrogen absorption can be as high as 1.0% to 1.2% by weight nitrogen. The major reason for this increase is that the partial pressure of nitrogen increases from $P_{N2}=0.25$ with dissociated ammonia to $P_{N2}=0.80$ with a 20% hydrogen, 80% nitrogen mixture. The use of trace additions of water vapor, oxygen, nitrous oxide, carbon dioxide or mixtures thereof to the gas stream will allow reduction in the amount of nitrogen absorbed down to a level of 0.1% to 0.3%. This is similar to the amount absorbed during annealing in a dissociated ammonia atmosphere. Although humidification to prevent nitrogen absorption is not scientifically new, it is believed that its use for industrial gas hydrogen-nitrogen mixtures at compositions other than 25% nitrogen, 75% hydrogen represents a new application of this principle, particularly for mixtures with greater than 50% nitrogen. Koebel used pure nitrogen for some of his humidification tests and from time to time, refers in general terms to the use of water to "prevent nitriding of hydrogen-nitrogen atmospheres." The major reason for his research, however, appears to have been aimed at perfecting techniques for use with dissociated ammonia atmospheres.

Besides those mentioned, another differentiating factor between 75%$H_2$-25%$N_2$ mixtures and dissociated ammonia is that the latter almost always contains 50–500 ppm or a trace amount of ammonia. Thus, workers in the art would not expect trials run with a 75%

$H_2$-25% $N_2$ mixtures to give the same results as an industrial dissociated ammonia atmosphere at identical dew points.

Following is a summary of tests run to establish the basis for the invention herein described:

EXAMPLE 1

A series of experiments was carried out to investigate the nitriding of stainless steel under annealing conditions. A strip of Type 302 stainless steel measuring 0.005 cm. (0.002 inches) thick and 2 cm. (0.781 in.) square was suspended from a sensitive balance in a vertical tube furnace heated to 1,040° C. (1,900° F.). The balance permitted constant monitoring of the weight of the strip so any loss or gain of weight would be measured. The furnace had provision for rapidly cooling the strip, after which it could be removed for chemical analysis.

Pure hydrogen was first passed through the furnace for one hour in order to remove any volatile contaminants and to reduce the protective coat of chromium oxide on the surface of the steel. A mixture of hydrogen and nitrogen of known composition was then passed through the furnace whereupon the strip increased in weight. The experiment was continued until the weight of the strip remained constant. It was then cooled and removed for chemical analysis. This procedure was repeated for a variety of hydrogen-nitrogen mixtures containing from 25–100% nitrogen in contact with test strips when heated to 1040° C. (1904° F.) in an atmosphere maintained at a dew point of less than −60° C. (−76° F.). Chemical analysis showed that the weight gain was due to the absorption of nitrogen by the stainless steel strip and nothing else. There was excellent agreement between the weight gain as determined by the sensitive balance and the percentage nitrogen in the stainless steel strip as determined by chemical analysis. The results of this series of experiments are summarized in Table I and shown in FIG. 1 which is a plot of weight percent nitrogen in the stainless steel strip against volume percent nitrogen in the nitrogen-hydrogen atmosphere.

TABLE I

Nitriding of Stainless Steel for Various $H_2$—$N_2$ Mixture at 1040° C.

| % $H_2$ | % $N_2$ | D.P.[1]°C. | % N[2](in steel) |
|---|---|---|---|
| 0 | 100 | −64.2 | 1.19 |
| 0 | 100 | −65.7 | 1.00 |
| 0 | 100 | −63.6 | .78 |
| 5.4 | 94.6 | −62.6 | 1.03 |
| 5.2 | 94.8 | −63.3 | .90 |
| 9.3 | 90.7 | −64.8 | .879 |
| 9.9 | 90.0 | −71.7 | .762 |
| 10.4 | 89.6 | −65.7 | .969 |
| 20.2 | 79.8 | −74.0 | 1.18 |
| 20.0 | 80.0 | −64.0 | 1.11 |
| 20.0 | 80.0 | −62.0 | 1.05 |
| 20.0 | 80.0 | −70.4 | .958 |
| 20.1 | 79.9 | −70.8 | .933 |
| 20.2 | 79.8 | −70.8 | .975 |
| 60.2 | 39.8 | −72.3 | .887 |
| 50.0 | 50.0 | −70.2 | .724 |
| 49.8 | 50.2 | −71.3 | .681 |
| 49.1 | 50.9 | −65.0 | .679 |
| 62.2 | 37.8 | −63.9 | .60 |
| 62.2 | 37.8 | −65.7 | .56 |
| 72.2 | 27.8 | −62.8 | .515 |

[1]Dew Point
[2]by weight

It will be noted that the amount of nitrogen picked up by the stainless steel exposed to pure nitrogen is approximately twice that absorbed when the atmosphere contains only 25% nitrogen.

EXAMPLE 2

A series of experiments similar to those described in Example 1 was carried out to demonstrate the beneficial inhibiting effect of water in nitrogen-hydrogen atmospheres. Stainless steel strips were suspended in the vertical furnace, held at 1,040° C. (1904° F.), and after pretreatment with pure hydrogen were exposed to a series of four different atmospheres as shown in Table II:

TABLE II

Effect of Humidification on Inhibition of Nitriding by $H_2$—$N_2$ Annealing Atmosphere at 1040° C.

| % $H_2$ | % $N_2$ | % Ar[1] | D.P.[2]°C. | % N[3] | $\frac{P_{H_2O}}{P_{H_2}} \times 10^5$ |
|---|---|---|---|---|---|
| 11.2 | 88.8 | — | −71.7 | .762 | 1.8 |
| 9.9 | 90.1 | — | −58.2 | .595 | 13.7 |
| 10.3 | 89.7 | — | −54.5 | .432 | 21.4 |
| 10.3 | 89.7 | — | −46.6 | .213 | 57.1 |
| 10.3 | 89.7 | — | −41.2 | .195 | 107.7 |
| 20.0 | 80 | — | −67.6 | 1.06 | 1.8 |
| 20.5 | 79.5 | — | −56.5 | .727 | 8.3 |
| 20.0 | 80.0 | — | −50.8 | .693 | 17.6 |
| 20.0 | 80.0 | — | −44.2 | .353 | 39.1 |
| 20.0 | 80.0 | — | −40.2 | .117 | 62.1 |
| 19.9 | 80.1 | — | −38.2 | .054 | 78.2 |
| 19.3 | 80.7 | — | −53.8 | .605 | 12.5 |
| 20.1 | 79.9 | — | −47.8 | .328 | 25.3 |
| 19.9 | 80.1 | — | −45.1 | .334 | 35.4 |
| 19.9 | 80.1 | — | −42.2 | .304 | 49.7 |
| 19.0 | 81.0 | — | −40.9 | .134 | 60.4 |
| 19.2 | 80.8 | — | −37.8 | .098 | 84.8 |
| 9.4 | 81.4 | 9.2 | −69.6 | .682 | 2.9 |
| 10.2 | 81.5 | 8.3 | −60.3 | .597 | 10.0 |
| 10.3 | 81.5 | 8.2 | −55.4 | .582 | 19.0 |
| 9.0 | 81.9 | 9.1 | −47.3 | .356 | 60.1 |
| 10.3 | 81.5 | 8.2 | −42.4 | .199 | 93.8 |
| 5.2 | 81.6 | 13.2 | −66.9 | .689 | 7.8 |
| 5.2 | 81.7 | 13.1 | −55.3 | .272 | 38.1 |
| 5.2 | 81.6 | 13.2 | −50.2 | .208 | 72.9 |
| 5.7 | 81.9 | 12.4 | −47.3 | .162 | 94.9 |

[1]by difference, not analyzed.
[2]dew point
[3]by weight in Steel

Figure 2:
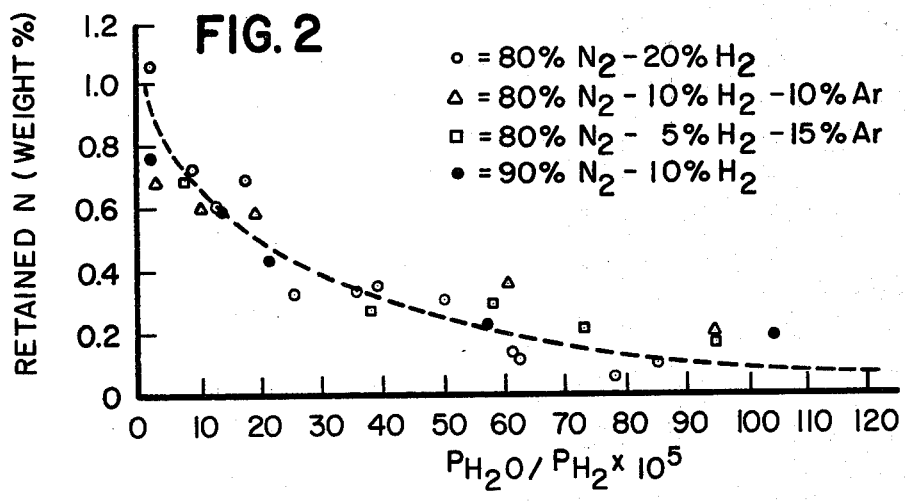
FIG. 2 is a plot of percent by weight of retained nitrogen against the ratio of partial pressure of water vapor to the partial pressure of hydrogen for samples annealed at 1040° C. (1904° F.) in four different hydrogen-nitrogen atmospheres.

Argon was used to replace part of the hydrogen in several atmospheres so that the percentage nitrogen could be held at 80 while the percentage of hydrogen was varied. Argon is completely inert and does not enter into any reaction with stainless steel. These basic atmospheres were humidified to varying extents before being passed into the furnace and the weight gain of the strip was observed as before, the experiment being terminated when no further increase in mass occured. Chemical analysis again showed that in each case the weight gain was due entirely to adsorption of nitrogen. FIG. 2 shows the percentage nitrogen in the stainless steel strip plotted against the function $P_{H_2O}/P_{H_2} \times 10^5$. All of the experimental points were in excellent agreement with the line shown in FIG. 2. This demonstrates that water is effective in limiting the absorption of nitrogen by stainless steel at elevated temperatures and further that the degree of inhibition rises with the water content of the atmosphere. The correlation with the special function shown as the abscissa shows that the amount of water required to achieve a given level of inhibition increases proportionally with the hydrogen content of the atmosphere.

EXAMPLE 3

Figure 3:
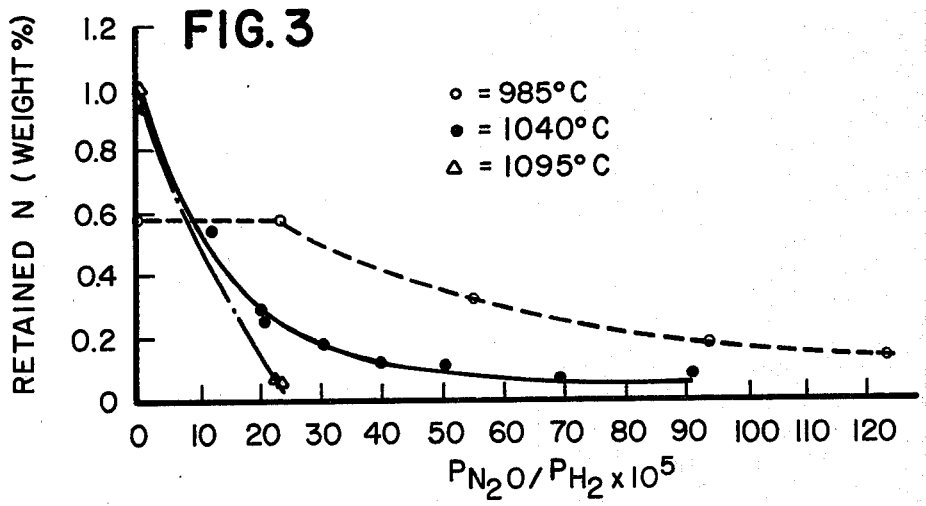
FIG. 3 is a plot of percent by weight of retained nitrogen against the ratio of partial pressure of nitrous oxide to the partial pressure of hydrogen for samples annealed at various temperatures in an atmosphere of by volume 80% nitrogen-20% hydrogen.

A series of experiments were carried out to demonstrate the effect of nitrous oxide in inhibiting nitriding of stainless steel. The equipment and experimental technique employed is the same as that used in Example 2, except that nitrous oxide was added to the atmosphere of 80% nitrogen and 20% hydrogen. Determinations were made at three temperatures, 985° C., 1,040° C. and 1,095° C. (1,800° F., 1,900° F. and 2,000° F.). The results are tabulated in Table III and shown in FIG. 3. It will be noted that the inhibitory effect of nitrous oxide increases as the temperature is lowered.

TABLE III

Effect of Trace $N_2O$ Addition on Inhibition of Nitriding by a 80% $N_2$-20% $H_2$

| T °C. | % $H_2$ | % $N_2O$ | % N(1) | $\frac{P_{N_2O}}{P_{H_2}} \times 10^5$ |
|---|---|---|---|---|
| 1095 | 20.6 | 0 | .572 | 0 |
| 1095 | 19.9 | .004 | .570 | 20.1 |
| 1095 | 19.1 | .0105 | .318 | 55.0 |
| 1095 | 19.1 | .0178 | .187 | 93.2 |
| 1095 | 19.0 | .0233 | .140 | 122.6 |
| 1040 | 20.1 | 0 | .933 | 0 |
| 1040 | 19.9 | .004 | .289 | 20.1 |
| 1040 | 19.9 | .0107 | .117 | 53.8 |
| 1040 | 19.8 | .0179 | .082 | 90.4 |
| 1040 | 19.0 | .0025 | .546 | 13.2 |
| 1040 | 19.5 | .004 | .254 | 20.5 |
| 1040 | 20.2 | .0062 | .178 | 30.7 |
| 1040 | 19.5 | .0081 | .122 | 41.5 |
| 1040 | 19.4 | .0134 | .072 | 69.1 |
| 985 | 20.1 | 0 | 1.01 | 0 |
| 985 | 20.0 | .004 | .064 | 20.0 |
| 985 | 20.5 | .004 | .068 | 19.5 |

(1)by weight in Steel

EXAMPLE 4

Figure 4:
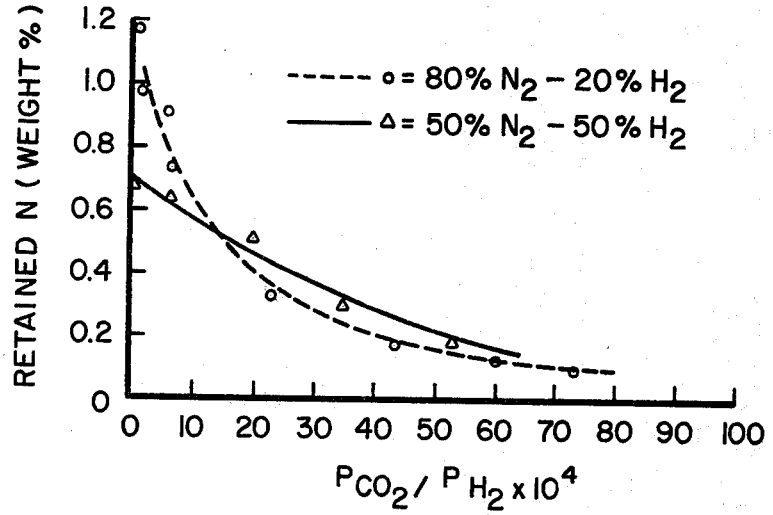
FIG. 4 is a plot of percent by weight of retained Nitrogen against the ratio of partial pressure of carbon dioxide to partial pressure of hydrogen for samples annealed at 1040° C. (1904° F.) in two different hydrogen-nitrogen atmospheres.

A series of experiments were carried out to demonstrate the inhibitory effect of carbon dioxide on the nitriding of stainless steel in hydrogen-nitrogen atmospheres. The equipment and experimental approach is the same as that employed in Example 2 except that carbon dioxide was added to the hydrogen-nitrogen mixture, and two different hydrogen-nitrogen mixtures were employed. The results are tabulated in Table IV and shown in FIG. 4. It will be noted that carbon dioxide is about one-tenth as effective as nitrous oxide in inhibiting nitriding.

TABLE IV

Effect of Low-Level $CO_2$ Additions on Inhibition of Nitriding by $H_2$—$N_2$ Annealing Atmospheres at 1040° C.

| % $H_2$ | % $CO_2$ | % N(1) | $\frac{P_{CO_2}}{P_{H_2}} \times 10^4$ |
|---|---|---|---|
| 20.8 | 0 | 1.17 | 0 |
| 20.2 | .012 | .911 | 5.9 |
| 20.1 | .121 | .169 | 60.2 |
| 20.2 | 0 | .975 | 0 |
| 20.2 | .013 | .739 | 6.4 |
| 18.6 | .043 | .329 | 23.1 |
| 18.8 | .079 | .173 | 42.0 |
| 19.1 | .140 | .092 | 73.3 |
| 51.6 | 0 | .675 | 0 |
| 50.5 | .030 | .618 | 5.9 |
| 50.5 | .100 | .510 | 19.8 |
| 50.6 | .176 | .297 | 34.8 |
| 49.8 | .265 | .183 | 53.2 |

(1)by weight in Steel

EXAMPLE 5

A pair of experiments were carried out to demonstrate the extreme activity of oxygen toward stainless steel. The apparatus and experimental approach were the same as those employed in Example 3 except oxygen was added at two levels (10 and 20 ppm) to an atmosphere of 80% $N_2$-20% $H_2$ at 1,040° C. Addition of 10 ppm $O_2$ resulted in only 0.5% nitrogen uptake. Addition of 20 ppm $O_2$ resulted in a final nitrogen level of 0.19% as shown in Table V.

TABLE V

Comparison of Oxygen with Water as Inhibitor of Nitriding at 1040° C.

| % $H_2$ | % $O_2$ | % N(1) | $\frac{P_{O_2}}{P_{H_2}} \times 10^5$ |
|---|---|---|---|
| 20.8 | .001 | .502 | 4.8 |
| 20.6 | .002 | .190 | 9.7 |

(1)by weight in Steel

Figure 5:
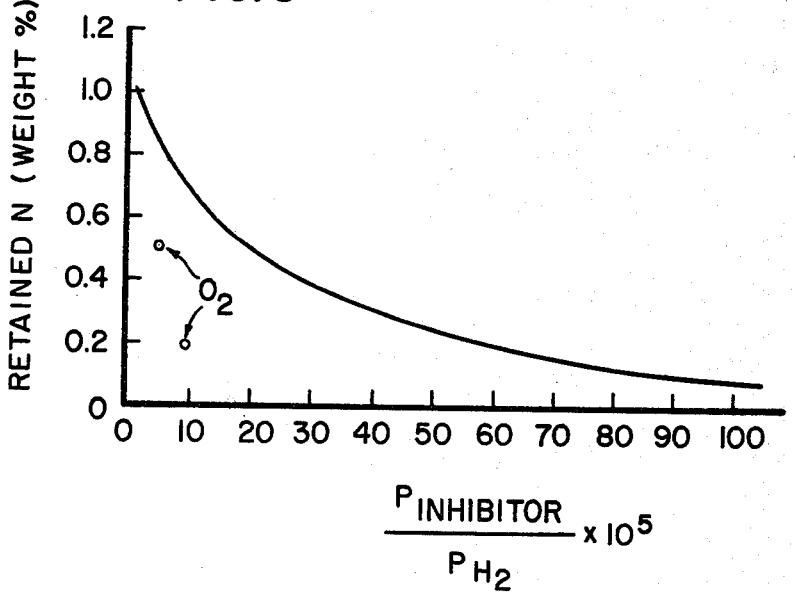
FIG. 5 is a plot of percent by weight of retained nitrogen against the ratio of partial pressure of oxygen or water vapor to partial pressure of hydrogen for samples annealed at 1040° C. (1904° F.) in an atmosphere of by volume, 80% nitrogen-20% hydrogen.

These oxygen levels have been converted to $P_{O_2}/P_{H_2}$ values and are plotted in FIG. 5, along with the curve from FIG. 2 showing the effect of water on the nitriding of stainless steel. The quantity of oxygen which limits the nitrogen uptake to 0.5% is only one quarter the quantity of water required to accomplish the same result, while less than one-sixth as much oxygen as water is needed to reduce nitrogen uptake to 0.19%.

The process of the present invention was utilized to anneal an AISI Type 440C steel containing about 18% chromium and 1% carbon by weight. Under an atmosphere of 100% nitrogen at an atmosphere dew point of −20° F. the annealed samples showed no nitrogen pick-up on the surface. Some surface discoloration was noted, however this is not objectionable.

The process of the invention can be utilized to anneal ferrous metals alloyed or unalloyed with chromium over a temperature range of 1200° F. (649° C.) to 2300° F. (1260° C.).

Having thus described our invention, what is claimed and desired to be covered by Letters Patent of the United States is set forth in the appended claims:

1. In a process for annealing ferrous metal articles containing at least 8% chromium by weight in a furnace heated to a temperature in excess of 1700° F. and in an atmosphere containing greater than 25% by volume nitrogen balance hydrogen the improvement comprising:

adding to said furnace atmosphere an amount of nitrous oxide inhibitor; and monitoring said furnace atmosphere to maintain the ratio of the partial pressure of the inhibitor to the partial pressure of hydrogen as defined in the formula $$P_{inhibitor}/P_{H_2}$$

at a minimum value of $10\times10^{-5}$ for nitrous oxide, whereby nitrogen pick-up by said article is held to below 0.3%.

2. A process for annealing ferrous metal articles containing a minimum of 8% by weight chromium as an alloying addition comprising the steps of:

charging said articles to be annealed into a furnace;

heating said articles to a temperature of between 1700° and 2100° F. under an atmosphere consisting of greater than 25% nitrogen balance hydrogen;

injecting into said furnace atmosphere nitrous oxide inhibitor; and monitoring said furnace atmosphere to maintain the dew point of the furnace atmosphere at −30° F. or less.

3. A method according to claim 2 wherein for a given temperature and partial pressure of nitrogen in said furnace the ratio of the partial pressure of the inhibitor to the partial pressure of the hydrogen in said atmosphere as defined in the formula $$P_{inhibitor}/P_{H2}$$

is maintained at a minimum value of $10\times10^{-5}$ for nitrous oxide.

4. A method of annealing chromium-nickel stainless steel comprising the steps of charging said steel into an annealing furnace;

heating said articles to a temperature of between 1700° F. and 2100° F. under an atmosphere consisting of by volume from 50 to 95% nitrogen and 5–50% by volume hydrogen;

injecting into said furnace atmosphere nitrous oxide inhibitor; and monitoring said furnace atmosphere to maintain the dew point of the furnace atmosphere at −30° F. or less.

5. A method according to claim 4 wherein for a given temperature and partial pressure of nitrogen in said furnace, the ratio of the partial pressure of the inhibitor to the partial pressure of the hydrogen in said atmosphere as defined in the formula $$P_{inhibitor}/P_{H2}$$

is maintained at a minimum value of $10\times10^{-5}$ for nitrous oxide.

* * * * *